United States Patent [19]

Akiike et al.

[11] Patent Number: 4,670,728

[45] Date of Patent: Jun. 2, 1987

[54] THERMAL TYPE OVERLOAD RELAY

[75] Inventors: Katsumi Akiike; Haruo Ichikawa; Kanichi Izumi; Tadayoshi Onodera, all of Saitama, Japan

[73] Assignee: Fuji Electric Co., Ltd., Kawasaki, Japan

[21] Appl. No.: 848,996

[22] Filed: Apr. 7, 1986

[51] Int. Cl.[4] ..... H01H 71/16

[52] U.S. Cl. ..... 337/49; 337/42; 337/79

[58] Field of Search ..... 337/42, 43, 44, 79, 337/68, 70, 82, 337, 338, 339, 340, 347, 348, 356, 357, 358

[56] References Cited

U.S. PATENT DOCUMENTS 3,800,260 3/1974 Woodger ..... 337/49

*Primary Examiner*—Harold Broome

*Attorney, Agent, or Firm*—Brumbaugh, Graves, Donohue & Raymond

[57] ABSTRACT

A thermal-type overload relay which uses a bimetallic element for sensing overload currents includes a shifter controlled by the bimetallic element to shift a release lever to which is attached a spring. The spring controls a movable board which has two reversible stable positions corresponding respectively to turn off or on a pair of normally open contacts and a pair of normally closed contacts.The movable board is a molding of insulated material carrying a pair of spaced insulated contacts and also includes a segment which is externally visible to display an indication of which pair of contacts is open and which is closed.

2 Claims, 4 Drawing Figures

THERMAL TYPE OVERLOAD RELAY

FIELD OF THE INVENTION

This invention relates to a thermal type overload relay including both normally open and normally closed contact units insulated from each other and operable at adjustable potentials.

BACKGROUND OF THE INVENTION

As conventional relays of the above type, a structure such as shown in FIGS. 1 and 2 is known. This thermal type overload relay shown partially in these drawings is so designed to be usable in common in automatic and manual restore modes. An insulating casing 1 of the relay includes as principal components, main bimetal 2 around which heating members (not shown) of three phases are wound that are connected into a power line, a shifter 3 engaging a free end 2*a* of the corresponding main bimetal 2 and supported in a guide groove 1*a* of the casing 1 and moveable in the direction of the arrow P in response to bending of the main bimetal 2, a switching mechanism 4 disposed in the casing 1 engaging one end of the shifter 3, a contact unit 5 whose turning-on/off is controlled by the switching mechanism 4, and a restoring unit 6, inoperative when the contact unit 5 is in the automatic restore or reset mode and controllable in the case of the manual restore or reset mode. The switching mechanism 4 is composed of a release lever 8 supported rotatably by the inner wall of the casing 1 at a point W via an adjusting link unit 7 and engaging a reversing mechanism hereinafter described, a temperature compensation bimetal 9 integral with the release lever 8 and engagable at a free end thereof with the end of the shifter 3, an adjusting link 10, whose one end forming a part of the adjusting link unit 7 is coupled by a pin at a point X to the release lever 8, supported rotatably at the above-mentioned point W, a cam 11*a* of an adjusting dial 11 engaging the other end of the adjusting link 10, and a spring 12 for pushing the other end of the adjusting link 10 against the cam 11*a*. The contact unit 5 is composed of a normally open contact section 13 and a normally closed contact section 14 insulated from each other and workable at different potentials, and the reversing mechanism 15. The normally open contact section 13 is composed of a terminal 19 and a movable board 18 to which are attached a normally open side movable contact 16 and a driving board 17 made of insulating material, and a normally open side fixed contact 21 attached to the casing 1 by a terminal 20 and capable of coming into and out of contact with the normally open side movable contact 16. The normally closed contact section 14 is composed of a normally closed side movable contact 23 attached to the casing 1 via a terminal 22 actuated by the driving board 17 of the movable board 18, and a normally closed side fixed contact 25 attached to the casing 1 via a terminal 24 so as to come into and out of contact with the normally closed side movable contact 23. The contact unit 5 includes an operation display segment 26 which is supported swingably by the casing 1 with one end engaging the driving board 17 and displays the state of the normally open contact section 13 and normally closed contact section 14. The reversing mechanism 15 is composed of the movable board 18 of the foregoing normally open contact section 13 supported swingably in a V-shaped groove 19*a* formed in the terminal 19, and a tension spring 27 for switching of the contacts, which is stretched between the movable board 18 and a lock groove 19*b* of the terminal 19 and reverses the movable board 18 when it is pushed by engaging an end portion 8*a* of the release lever 8 and its line of action crosses a point Z of the V-shaped groove 19*a*. While the contact unit 5 is illustrated in the state set to the manual return mode, it is necessary in the case of the automatic return mode to push down a control rod 28 of the return unit 6 to the position illustrated by the dashed line thereby to lower the normally open side fixed contact 21.

The operation of this structure will now be described with reference also to the schematic of FIG. 2, which illustrates the principle of the contact sections. As an overcurrent flows through the heating member coiled around the main bimetal 2, heating of the heating member causes the main bimetal 2 to bend thereby to move the shifter 3 in the direction of the arrow P. Due to movement of the shifter 3, its end portion pushes the free end of the temperature compensation bimetal 9 and causes the release lever 8 integral with the member 9 to turn in the clockwise direction about the supporting point X. Due to turning of the release lever 8, its end portion 8*a* pushes a hook portion of the tension spring 27 of the reversing mechanism 15. When the angle formed between the direction of force Ps of the tension spring 27 and the movable board 18 crosses over a value of zero degrees (the dead point) the movable board 18 reverses to the position shown by the dot-dash line, so that the normally closed contact section 14 turns off and the normally open contact section 13 turns on. When it is desired to change the value of the switching current, the reversing point must be changed because the degree of heating of the heating member is not in accord with the extent of curving of the main bimetal 2 with respect to a variation of the working current. In this case, the relay can be adjusted by turning the adjusting dial 11 to rotate an abutting portion of the cam 11*a* on the other end of the adjusting link 10 about the supporting point W thereby shifting the supporting point X of the release lever 8.

As is apparent from the above, the conventional relay of the foregoing structure includes the operation display segment 26 made of insulating material exclusively for this role; the supporting point Z between the movable board 18 and the V-shaped groove 19*a* must have the ability of conducting and the function of reversing with a high degree of reliability; in this connection, the terminal 19 formed with the V-shaped groove 19*a* requires for manufacture a troublesome machining process because of its complexity in shape and relatively costly material; and the driving board 17 which is troublesome to mount (thermal caulking) must be used to ensure insulation between the normally open contact section 13 and the normally closed contact section 14. Therefore, this relay had the drawbacks that the number of parts is large, the time of assembly is long, and the manufacturing cost is high.

SUMMARY OF THE INVENTION

It is the object of the present invention to overcome the problems of this prior art structure, thus to provide a thermal type overload relay equipped with at least one pair of normally open and normally closed contact units operable at different potentials which has an enhanced degree of reliability in the contact action of the contact sections and a simplified structure for permitting a low cost of manufacture.

To these ends, the present invention is a thermal type overload relay comprising a shifter for transmitting displacement of a bimetal caused by an overcuttent, a release lever engaging one end with the shifter and turned by displacement of the bimetal via the shifter, and adjusting link connected to and supported rotatably by the release lever whose setting is controlled by cam of an adjusting dial, a movable board which has two reversible positions and which is connected to a tension spring engaging the release lever and which reverses its position when the line of action fo the tension spring crosses over a dead point in response to turning of the release lever, and at least one pair of normally open and normally closed contact units insulated from each other which turn on and off in response to reversing of position of the movable board, and is characterized in that the movable board is a mold of insulating material and has an operation display portion of an extended portion thereof, whereby the reliability of the contact units is enhanced and the number of parts is reduced thereby resulting in a simplified structure and a low manufacturing cost.

DESCRIPTION OF THE INVENTION

Figure 1:
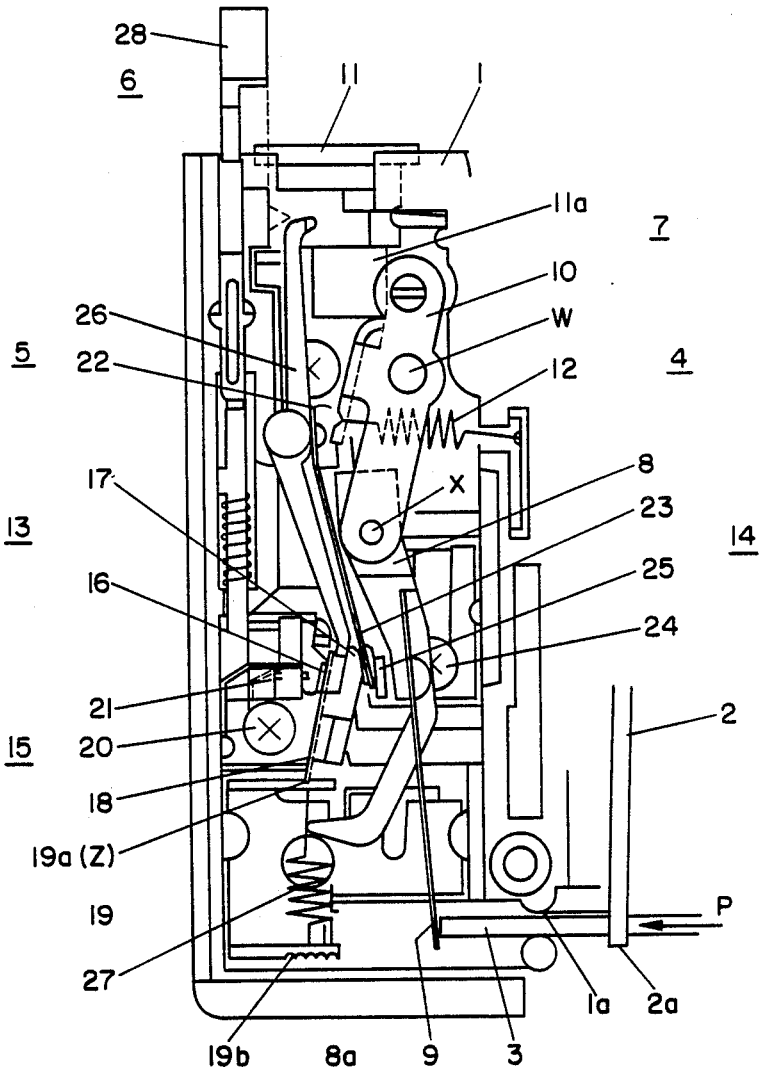
FIG. 1 (PRIOR ART)
FIG. 1 shows the basic components of a prior art form of thermal overload relay of the type of which the present invention is an improvement and FIG. 2 shows schematically the contacts portion of such a relay.
Figure 2:
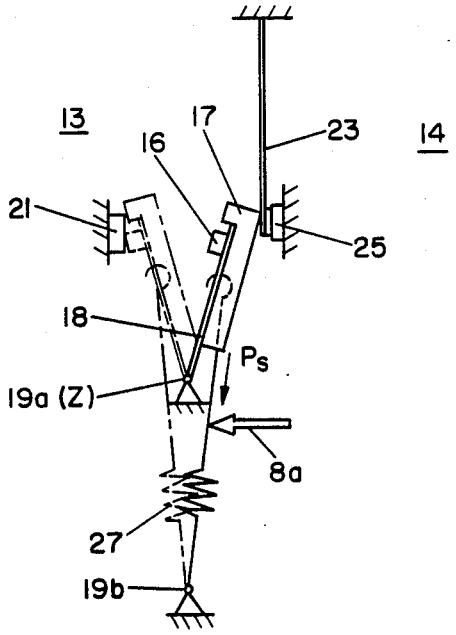
FIG. 2 (PRIOR ART)
Figure 3:
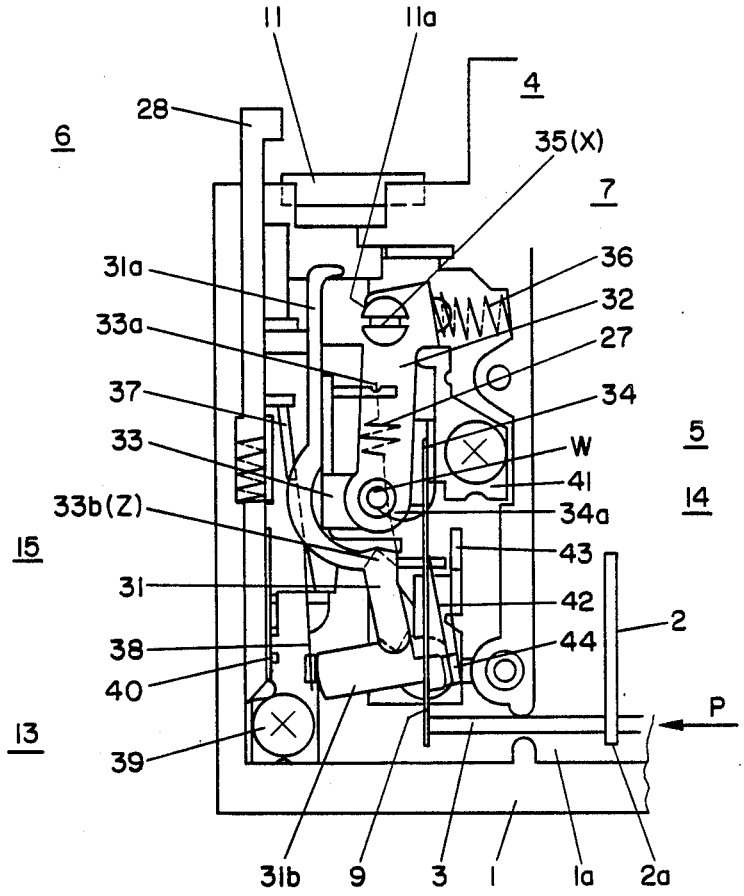
FIG. 3 shows in the fashion of FIG. 1 a thermal relay embodying the invention and FIG. 4 shows schematically the contacts portion of this embodiment.
Figure 4:
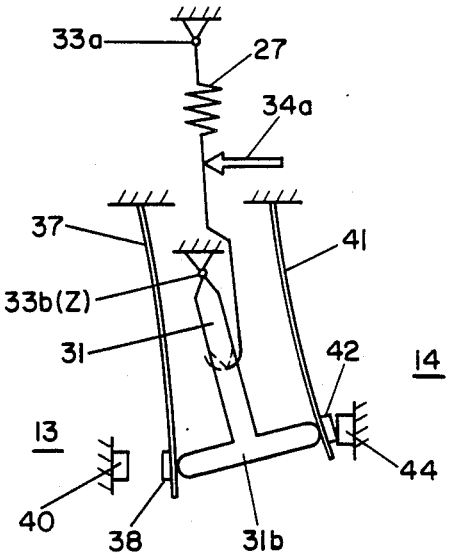

FIGS. 3 and 4 show in the manner of FIGS. 1 and 2 an embodiment of a thermal type overload relay according to the present invention. In these latter figures, parts corresponding to those of the conventional device shown in FIG. 1 bear the same reference numerals, and the present embodiment will now be described with emphasis on the differences from the conventional relay. Basic differences are that the movable board 31 forming the reversing mechanism 15 is a molding of synthetic resin, has no conducting role with the supporting point Z, and includes an operation display portion or segement 31*a* integral with the movable board 31. As in the prior art, the supporting point W of an adjusting link 32 of the adjusting link unit 7 is located via a fixed segment 33 on the line connecting a fixed side lock groove 33*a* of a tension spring 27 of the reversing mechanism 15 and a supporting point groove 33*b* (Z) of the movable board 31. A pin 35 coupling the adjusting link 32 and a release lever 34 of the switching mechanism 4 and functioning as the point X is disposed to abut on the cam 11*a* of the adjusting dial 11 and is pushed by a spring 36 interposed between the adjusting link 32 and the inner wall of the casing 1. On the other hand, the contact unit 5 is disposed to be on opposite sides of a driving base portion 31*b* formed integrally on the opposite end of the movable board 31 to the supporting point Z, and includes the normally open contact section 13 positioned on the left side of the driving portion 31*b* and the normally closed contact section 14 positioned on the right side of the driving portion 31*b*. The normally open contact section 13 is composed of a normally open side movable contact 38 attached via a terminal 37 to the casing and a normally open side fixed contact 40 attached via a terminal 39 to the casing 1. The normally closed contact section 14 is composed of a normally closed side movable contact 42 attached via a terminal 41 to the casing 1 and a normally closed side fixed contact 44 attached via a terminal 43 to the casing 1.

In the foregoing structure, the operation will now be described with reference also to FIG. 4 showing the principale of the contact sections. Similarly to the conventional device, as an overcurrent flows through the heating member coiled around the main bimetal 2, heating of the heating members causes the main bimetal 2 to bend thereby to move the shifter 3 in the direction of the arrow P. Due to movement of the shifter 3 its end portion pushes the free end of the temperature compensation bimetal 9 and causes a release lever 34 integral with the member 9 to turn in the clockwise direction about the supporting point X. Due to turning of the release lever 34 its end portion 34*a* pushes a hook portion of the tension spring 27 of the reversing mechanism 15, so that the two-position movable board 31 is reversed in position, the normally closed contact section 14 turns off, and the normally open contact section 13 turns on. To change the switching current, it is enough to change an engaging portion between the temperature compensation bimetal 9 made integral with the release lever 34 and the point of the shifter 3 by turning the adjusting dial 11 to rotate the supporting point X where the cam 11*a* abuts on the pin 35 about the supporting point W of the adjusting link 32.

Therefore, in the foregoing structure, because the movable board 31 which provides the reversing action is formed by a molding of insulating material, a slidable contacting portion is eliminated from the contact unit 5, insulation between the normally open contact section 13 and the normally closed contact section 14 is increased, and the capacities both for conducting and for insulating of the contact unit 5 are improved. Further, because the operation display segment 31*a* is formed integrally on the movable board 31, the number of parts inclusive of supporting elements is reduced, the structure is simplified, thereby reducing the cost of material and assembly, and the action of the contact unit 5 can be checked advantageously and externally by way of the operation display segment 31*a*.

Since the movable board of the reversing mechanism is formed by a molding of insulating material and the operation display segment is integral therewith thus, there is provided a thermal type overload relay of the kind desired that has an enhanced degree of reliability of contact of the contact units and a simplified structure that can be manufactured at low costs.

We claim:

1. A thermal type overload relay comprising a casing within which are included a shifter for transmitting displacement of a bimetal caused by an overcurrent, a release lever engaging said shifter and turned by displacement of said bimetal via said shifter, an adjusting link connected to and supported rotatably by said release lever adjustable by a cam of an adjusting dial, a movable board having two reversible positions connected to a tension spring engaging said release lever which reverses position when the line of action of said tension spring crosses over a dead point in response to turning of said release lever, and at least one pair of normally open and normally closed contact units insulated from each other, each including a first contact which is fixed relative to said casing and a second contact, which is on a rotatable end of a support member whose other end is fixed relative to said casing, which turn on and off in response to reversing of position of said movable board, characterized in that said movable board is a molding of insulating material and includes one end which is rotatably supported from said casing and an opposite end which includes a base driving portion having opposed sides each for driving a respective one of the rotatable ends of the support members and for putting the movable contact into or out of contact with the fixed contact of its pair of contact units.

2. A thermal type overload relay as in claim 1, wherein said movable board includes an operation display portion on an extended portion thereof for displaying the open or closed state of the contact units.

* * * * *

UNITED STATES PATENT AND TRADEMARK OFFICE

CERTIFICATE OF CORRECTION

PATENT NO. : 4,670,728

DATED : June 2, 1987

INVENTOR(S) : Akiike et al.

It is certified that error appears in the above-identified patent and that said Letters Patent is hereby corrected as shown below:

Title page, following Item [22], insert:
--[30] Foreign Application Priority Data
April 5, 1985 Japan 60-71956--

Signed and Sealed this

Fifteenth Day of December, 1987

*Attest:*

DONALD J. QUIGG

*Attesting Officer*

*Commissioner of Patents and Trademarks*